US010914142B2

(12) United States Patent
Salinas

(10) Patent No.: US 10,914,142 B2
(45) Date of Patent: Feb. 9, 2021

(54) EXPANSION ASSEMBLY FOR EXPANDABLE LINER HANGER

(71) Applicant: Halliburton Energy Services, Inc., Houston, TX (US)

(72) Inventor: Daniel Anthony Salinas, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/774,452

(22) PCT Filed: Dec. 30, 2016

(86) PCT No.: PCT/US2016/069557
§ 371 (c)(1),
(2) Date: May 8, 2018

(87) PCT Pub. No.: WO2018/125230
PCT Pub. Date: Jul. 5, 2018

(65) Prior Publication Data

US 2020/0284124 A1 Sep. 10, 2020

(51) Int. Cl.
*E21B 43/10* (2006.01)

(52) U.S. Cl.
CPC ..... *E21B 43/105* (2013.01); *E21B 43/103* (2013.01); *E21B 43/106* (2013.01); *E21B 43/108* (2013.01)

(58) Field of Classification Search
CPC ..... E21B 43/10; E21B 43/103; E21B 43/105; E21B 43/106; E21B 43/108
See application file for complete search history.

(56) References Cited

U.S. PATENT DOCUMENTS 3,191,677 A * 6/1965 Kinley ..... E21B 43/105 166/277
4,641,708 A 2/1987 Wightman
7,128,146 B2 * 10/2006 Baugh ..... E21B 43/105 166/206
7,559,365 B2 7/2009 Watson et al.
7,681,636 B2 * 3/2010 Roggeband ..... E21B 43/105 166/207
9,187,988 B2 * 11/2015 Abedrabbo ..... B21D 39/20
(Continued)

FOREIGN PATENT DOCUMENTS

JP 2002500306 A 1/2002
JP 4289686 B2 7/2009

*Primary Examiner* — Tara Schimpf
(74) *Attorney, Agent, or Firm* — Scott Richardson; Parker Justiss, P.C.

(57) ABSTRACT

The present disclosure provides an expansion assembly for setting a liner hanger into mating engagement with an interior surface of a wellbore casing. In one embodiment, the expansion assembly comprises a cone mandrel and an expanding cone assembly positioned adjacent the cone mandrel. The expanding cone assembly includes a plurality of sections, the plurality of sections positioned adjacent each other, each separable by a space S, and together forming an annular ring. The plurality of sections are configured to expand radially outward to a first outer diameter when subjected to a linear downhole force when moving downhole and to contract radially inward to a second smaller outer diameter when moving uphole.

20 Claims, 13 Drawing Sheets

(56) References Cited

U.S. PATENT DOCUMENTS

| | | | | |
|---|---|---|---|---|
| 2003/0075339 | A1 | 4/2003 | Gano et al. | |
| 2011/0000664 | A1* | 1/2011 | Adam | E21B 43/105<br>166/207 |
| 2014/0110136 | A1 | 4/2014 | Li et al. | |

* cited by examiner

EXPANSION ASSEMBLY FOR EXPANDABLE LINER HANGER

CROSS-REFERENCE TO RELATED APPLICATION

This application is the National Stage of, and therefore claims the benefit of, International Application No. PCT/US2016/069557 filed on Dec. 30, 2016, entitled "EXPANSION ASSEMBLY FOR EXPANDABLE LINER HANGER". The above application is commonly assigned with this National Stage application and is incorporated herein by reference in its entirety.

TECHNICAL FIELD

This application is directed, in general, to directional drilling systems and, more specifically, to an expansion assembly for an expandable liner hanger.

BACKGROUND

Drilling an oil or gas well traditionally involves creating a wellbore that traverses numerous subcutaneous formations. Conventional well construction includes a heavy steel casing. After an upper portion of the well is complete, casing string is installed and the construction of the next section begins. As the well is fabricated, each successive section is often constructed having a smaller diameter than the previous section to allow passage of the drill bit and other tools as the well is drilled deeper.

Wellbore casings include casing strings that are generally fixed within the wellbore by a cement layer between the outer wall of the casing and the wall of the wellbore. Once the casing string is positioned at a desired location, a cement slurry is pumped via the interior of the casing, around the lower end of the casing and upward into the annulus. The casing may also include one or more liner strings, which typically extend from near the bottom of a previous casing down into an uncased portion of the well. Liner strings are typically lowered downhole and include a liner hanger at its uphole end. The liner hanger must then be expanded outward into sealing or gripping engagement with the previously installed casing string. An expanding cone assembly may be used to push the liner hanger outward, but once the expanding cone has passed through and deformed the liner hanger outward, resilience in the casing string and the liner hanger may result in a reduction of the inner diameter of the liner hanger.

What is needed is an expansion assembly that works to push the liner hanger outward into engagement with the casing string while tolerating pressure and resilience from both the liner hanger and wellbore casing, but then contracts into a smaller outer diameter as the assembly is retracted.

BRIEF DESCRIPTION

Reference is now made to the following descriptions taken in conjunction with the accompanying drawings, in which.

DETAILED DESCRIPTION

During drilling and installation of an oil and gas well, after a wellbore casing is installed and casing string is secured in cement, a liner hanger is installed which should then be expanded outward into sealing or mating engagement with the cemented wellbore casing. To expand the liner hanger outward, a setting tool having an expansion assembly coupled thereto is inserted and run down the wellbore to push the liner hanger outward into engagement with the wellbore casing. However, due to resilience in the casing string and the liner hanger, a reduction in the inner diameter of the liner hanger may occur after the expansion tool has passed through.

Various expansion tools have been used, including expanding tubular structures and expansion assemblies having an expanding cone constructed from a flexible material such that the expanding cone can flex and compress into a smaller diameter to prevent catching on the liner hanger when withdrawing the assembly from the wellbore. While the flexible material may enable the expanding cone to collapse into a smaller outer diameter, the flexible material may have limitations on what strength of liner hangers it can be used to expand—as the flexible material in certain circumstances cannot withstand as much force as may be encountered during the expansion process and may not be able to be used for installation of certain liner hangers. Accordingly, the present disclosure provides for an expanding cone assembly comprising a plurality of individual sections positioned into an annular ring, which can be constructed using a stronger material to withstand higher pressures and accordingly be used to expand stronger liner hangers.

Figure 1:
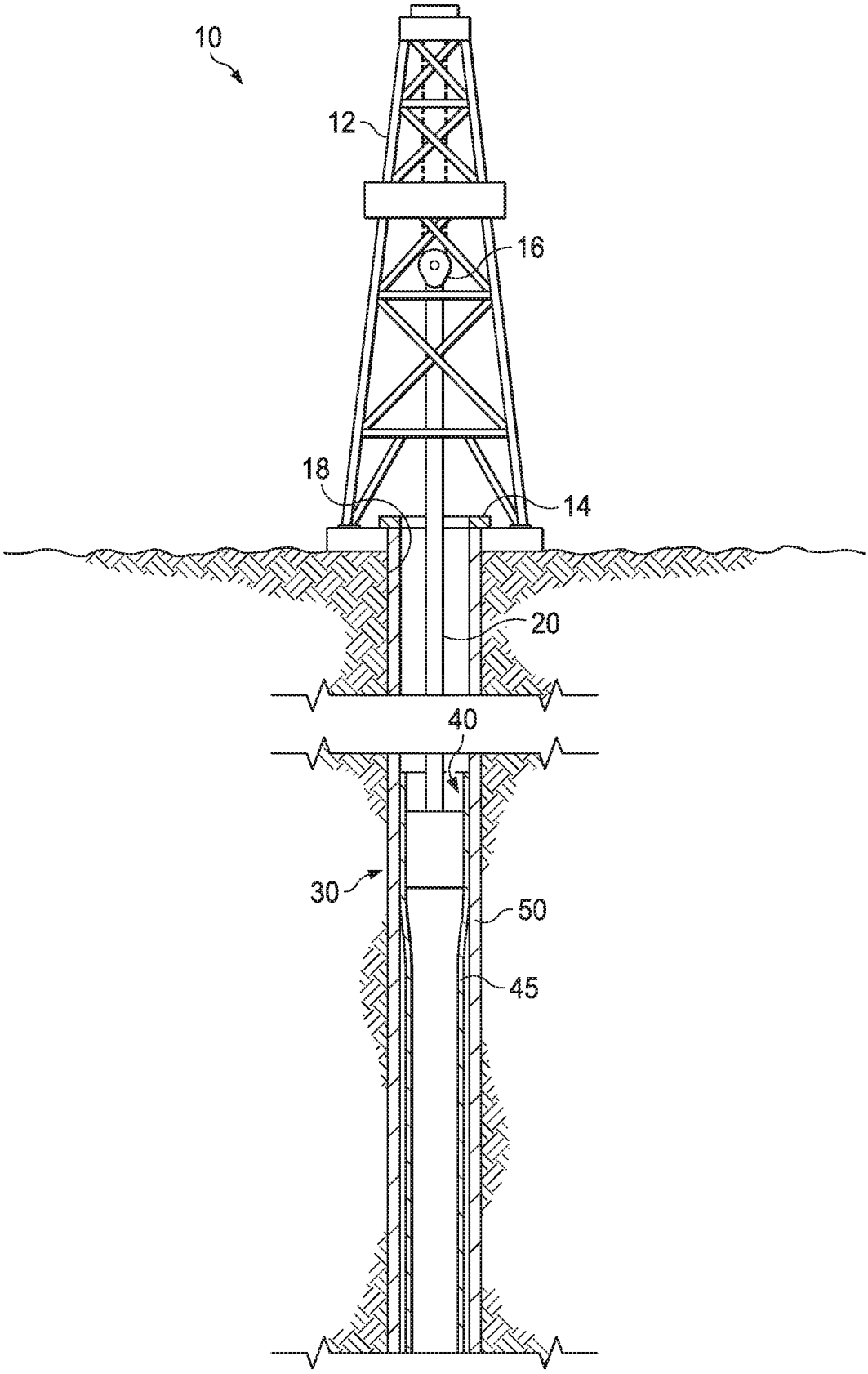
FIG. 1 is an environmental sectional view of an oil and gas platform installing a liner hanger in a casing string of a subcutaneous wellbore according to the present disclosure.

Reference will now be made to the drawings wherein like reference numerals identify similar structural features or aspects of the subject disclosure. For purposes of explanation and illustration, and not limitation, FIG. 1 illustrates an oil well 10 during operation thereof. Servicing Rig 12 sits over wellhead 14 and includes a hoisting apparatus 16 for raising and lowering pipe, strings, tools, etc. In the embodiment of FIG. 1, the hoisting apparatus 16 is connected to a work string 20 in the wellbore 18. An expansion assembly 30, according to the present disclosure, is shown lowered into a next section for construction. Liner string 40 including a liner hanger 45 is lowered into the wellbore 18. Expansion assembly 30 is used for setting the liner hanger 45 into a wellbore casing 50, and more specifically, for expanding the liner hanger 45 outward into sealing or mating engagement with wellbore casing 50 as the expansion assembly 30 is pushed downhole via hoisting apparatus 16 through the section of piping being installed and completed.

It is contemplated that the drilling system as described herein can be used in conjunction with a measurement-while-drilling (MWD) apparatus, which in one embodiment may be incorporated into the work string 20 for insertion in the wellbore 18 as part of a MWD system. In a MWD system, sensors associated with the MWD apparatus provide data to the MWD apparatus for communicating up the work string 20 to an operator of the drilling system. These sensors typically provide directional information of the work string 20 so that the operator can monitor the orientation of the work string 20 in response to data received from the MWD apparatus and adjust the orientation of the work string 20 in response to such data. An MWD system also typically enables the communication of data from the operator of the system down the wellbore 18 to the MWD apparatus. Systems and methods as disclosed herein can also be used in conjunction with logging-while-drilling (LWD) systems, which log data from sensors similar to those used in MWD systems as described herein.

Figure 2A:
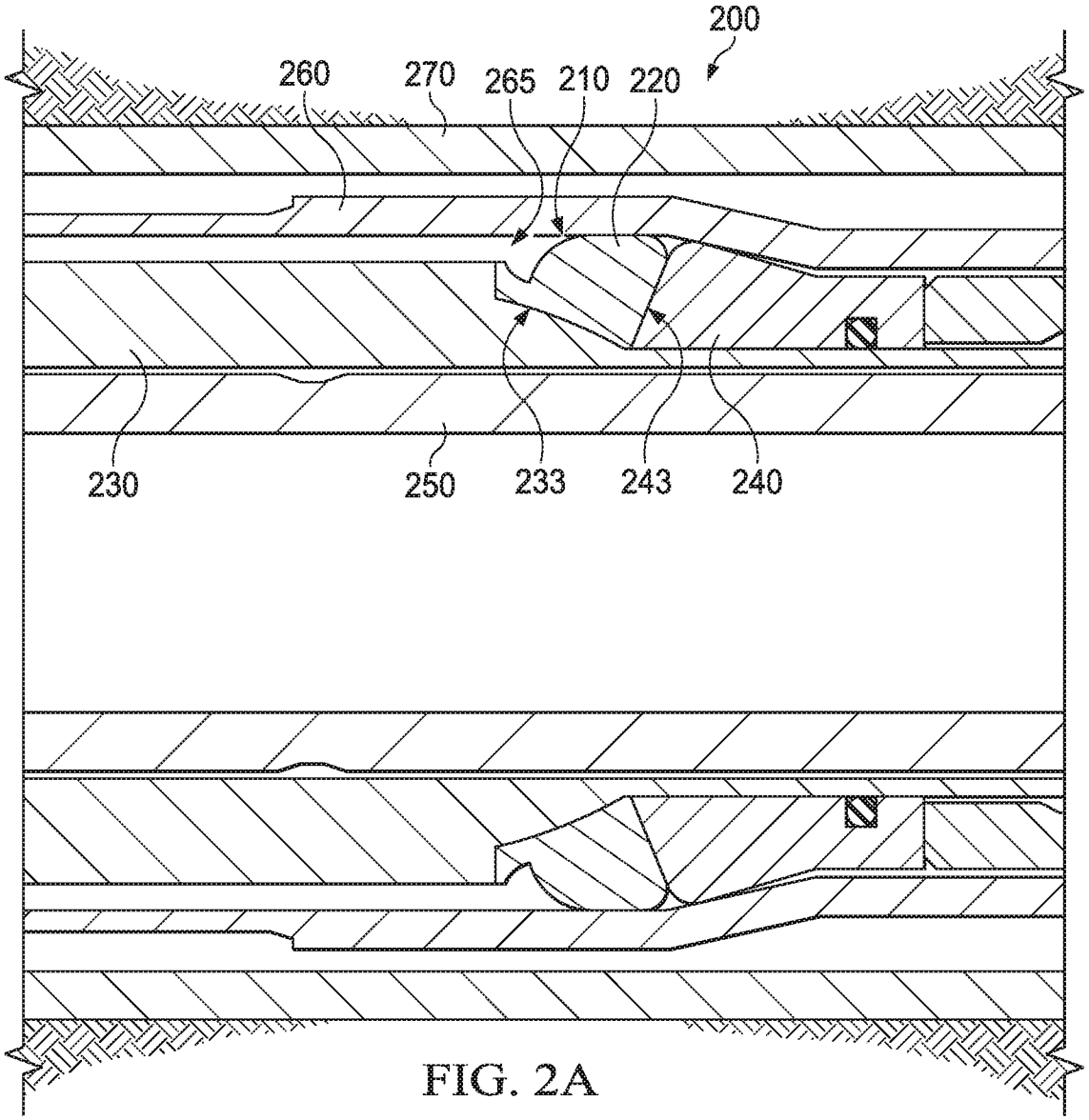
FIG. 2A is a sectional view of an expansion assembly according to aspects of the present disclosure.

FIG. 2A illustrates an expansion assembly 200, which may be used to expand a liner hanger 260 radially outward into engagement with a casing string in wellbore casing 270. The expansion assembly 200, in the embodiment shown, includes an expanding cone assembly 210 comprising a plurality of individual sections 220 which can individually radially expand outward into a first outer diameter when being inserted downhole into the well and then individually contract radially inward into a second smaller outer diameter when the expansion assembly 200 is being extracted uphole from the well. In this embodiment, the second smaller outer diameter prevents the expansion assembly 200 from catching on the liner hanger 260 during extraction.

In use, the expanding cone assembly 210 may be positioned between a cone mandrel 230 and lead cone 240. As those skilled in the art appreciate, the cone mandrel 230 is uphole of the expanding cone assembly 210, and the lead cone 240 is downhole of the expanding cone assembly 210. The cone mandrel 230, in this embodiment, has an angled face 233 at a distal end thereof. In one embodiment, the angled face 233 has an angle ($\theta$) ranging from about 10 degrees to about 45 degrees, and more particularly between about 15 degrees and about 35 degrees. In this embodiment, the expanding cone assembly 210 has an opposing face that substantially matches the angled face 233.

The lead cone 240 likewise, in one embodiment, includes an angular face 243. In one embodiment, the angular face 243 has an angle ($\alpha$) ranging from about 45 degrees to about 80 degrees, and more particularly between about 55 degrees and about 75 degrees. In this embodiment, the expanding cone assembly 210 has an opposing face that substantially matches the angular face 243.

As the expansion assembly 200 is pushed downhole, the plurality of individual sections 220 are squeezed between the angled face 233 of the cone mandrel 230 and against the angular face 243 of lead cone 240. As a result of the cooperating faces of the expanding cone assembly 210 and the cone mandrel 230 and lead cone 240, as well as the downhole pressure being exerted on the cone mandrel 230 and uphole pressure (e.g., friction from the liner hanger 260) being exerted on the lead cone 240, the expanding cone assembly 210 is forced radially outward as shown in FIG. 2A. The individual sections 220 will be maintained at the first outer diameter so long as there continues to be pressure exerted on the expanding cone assembly 210 by the cone mandrel 230 and lead cone 240. The expansion assembly 200 is shown in this embodiment without a cone shoe, but the expanding cone assembly 210 may be used in expansion assemblies with or without a cone shoe.

To set the liner hanger 260 into the wellbore casing 270, a setting tool 250, such as a seal mandrel, is operably associated with the expansion assembly 200 and a liner string 265. The liner string 265, expansion assembly 200, and setting tool 250 are lowered into the wellbore casing 270, or as applied to constructing lower portions of a well downhole, into a next downhole section of wellbore casing 270. A downhole force is applied to the expansion assembly 200 in a downhole direction, wherein the lead cone 240 applies an uphole force (e.g., linear uphole force) onto the expanding cone assembly 210, thereby expanding the expanding cone assembly 210 into the first outer diameter. As those skilled in the art now appreciate, the expanding cone assembly 210 and lead cone 240 work to push against and radially expand the liner hanger 260 outward such that at least a portion of the liner hanger 260 engages with the inner diameter of wellbore casing 270. Once the liner hanger 260 is set into the subject section of the wellbore, the setting tool 250 is decoupled from the liner string 265 and a force is applied in the uphole direction to extract the expansion assembly 200 from the subject segment of the wellbore. As the uphole force is applied to the expansion assembly 200, the expanding cone assembly 210 is drawn axially away from the lead cone 240. As this happens, the plurality of sections 220 shift radially inward and down the angular face 243 of the lead cone 240 into the second smaller outer diameter. The second smaller outer diameter is smaller than the radially expanded liner hanger 260, such that the expansion assembly 200 may be extracted without interference or catching with the liner hanger 260. The plurality of sections 220 may also shift angularly toward the lead cone 240, relative to the cone mandrel 230, as each plurality of sections 220 moves along the angular face 233.

Figure 2B:
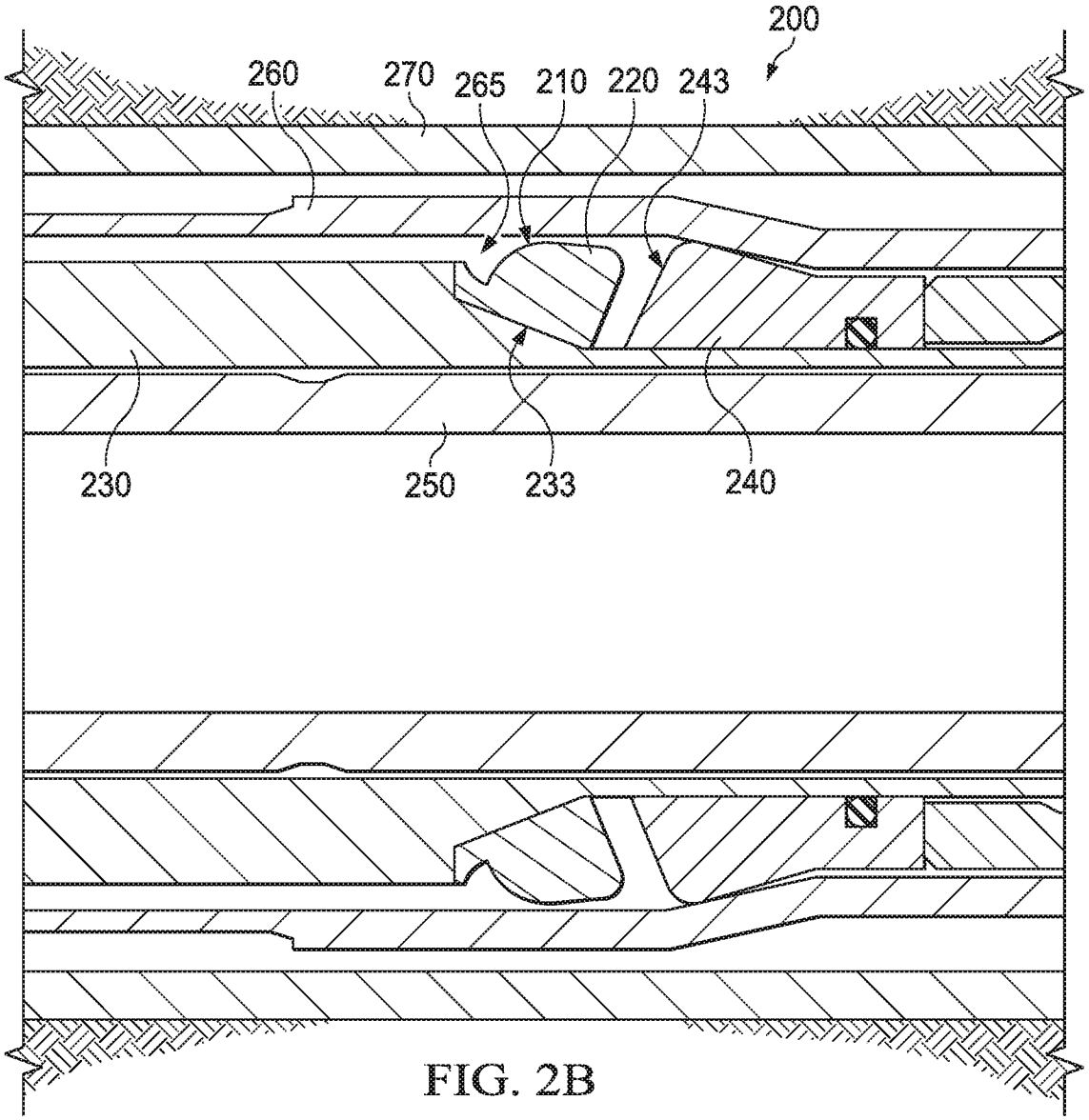
FIG. 2B illustrates a sectional view of the expansion assembly of FIG. 2A as it is being withdrawn uphole.

Turning briefly to FIG. 2B, illustrated is the expansion assembly 200 of FIG. 2A, as it is being withdrawn uphole. In this state of removal, the expansion assembly 200 is radially offset from the liner hanger 260, thereby allowing it to being removed without concern for it hanging on the liner hanger 260.

Figure 2C:
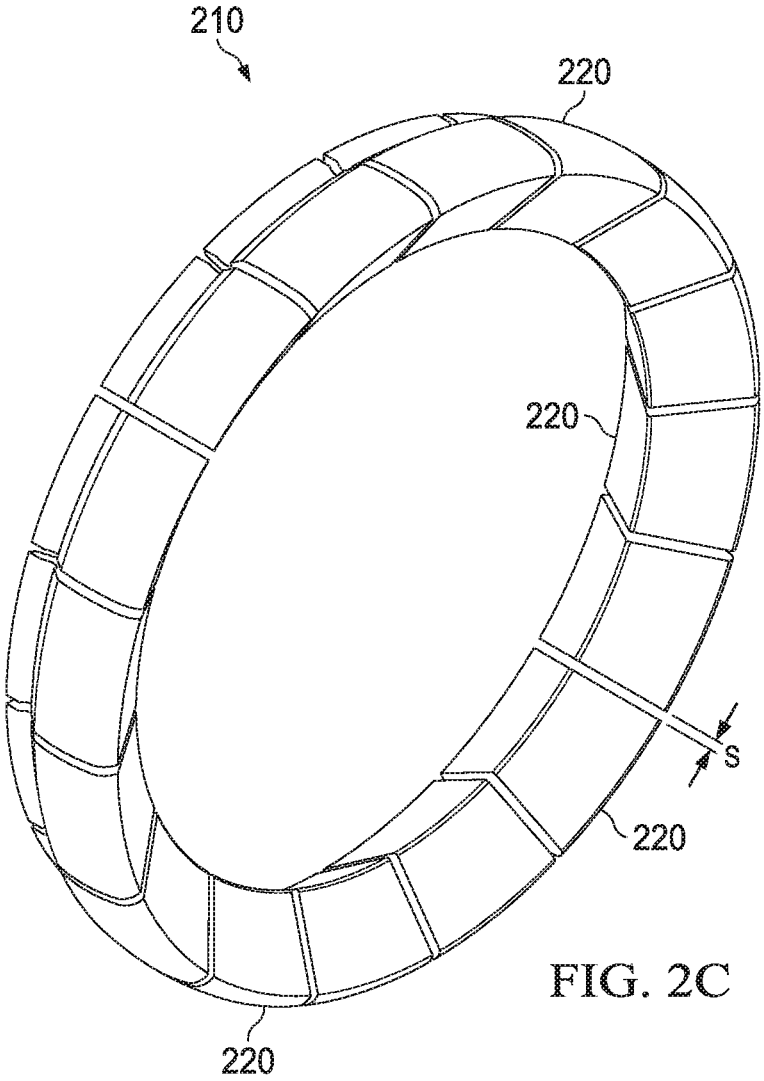
FIG. 2C is a perspective view of an expanding cone assembly according to aspects of the present disclosure that may be used in the expansion assembly shown in FIGS. 2A and 2B.

FIG. 2C illustrates a perspective view of the expanding cone assembly 210 of FIGS. 2A and 2B. Expanding cone assembly 210 includes the plurality of sections 220 which are positioned together as an annular ring and configured to be positioned around a distal end of a cone mandrel, such as the cone mandrel 230. Spacing S between the plurality of sections 220 enables the expanding cone assembly 210 to expand and collapse radially between at least a first outer diameter as the expansion assembly 200 is inserted downward into the wellbore, and contract into a second smaller outer diameter as the expansion assembly 200 is extracted from the wellbore. The number of plurality of sections 220 and spacing S between each of the plurality of sections 220 may vary according to the diameter of the wellbore sections in which the expansion assembly 200 is inserted. In some configurations, there may be at least four individual sections 220 sections, and in some configurations, there may be 10 or more individual sections 220 (e.g., in one embodiment up to as many as 16 to 20 individual sections 220). In one embodiment, the spacing S is void of any material other than air or fluid, and particularly void of separate metal, plastic or other similar materials.

The plurality of sections 220 may be constructed of a rigid material such as D2 Tool Steel, and materials having a similar, or stronger, tensile strength, which can withstand higher pressures exerted by various types of liner hangers and wellbore casings. Similarly, less stress is placed on the cone mandrel 230 and setting tool 250, than existing cones constructed of flexible material—the flexible material not having the physical properties to withstand high pressures. The expanding cone assembly 210 may be coupled with the cone mandrel 230 by fasteners, a compressive ring, a c-ring, or a tension fit as will be illustrated and described herein, among others.

A finite element analysis (FEA) stress test was done using the expanding cone assembly 210 according to FIGS. 2A and 2B, versus a conventional expansion assembly having a cone made from weaker, more flexible material. In this test, 182,000 pounds of force was exerted by a liner hanger and wellbore casing onto a conventional expansion assembly, and the conventional cone and cone mandrel experienced a stress of about 150 ksi (not averaged). When the same amount of force was applied to the expanding cone assembly manufactured in accordance with the present disclosure, the expanding cone assembly experienced a peak stress of only about 104 ksi.

Figure 3:
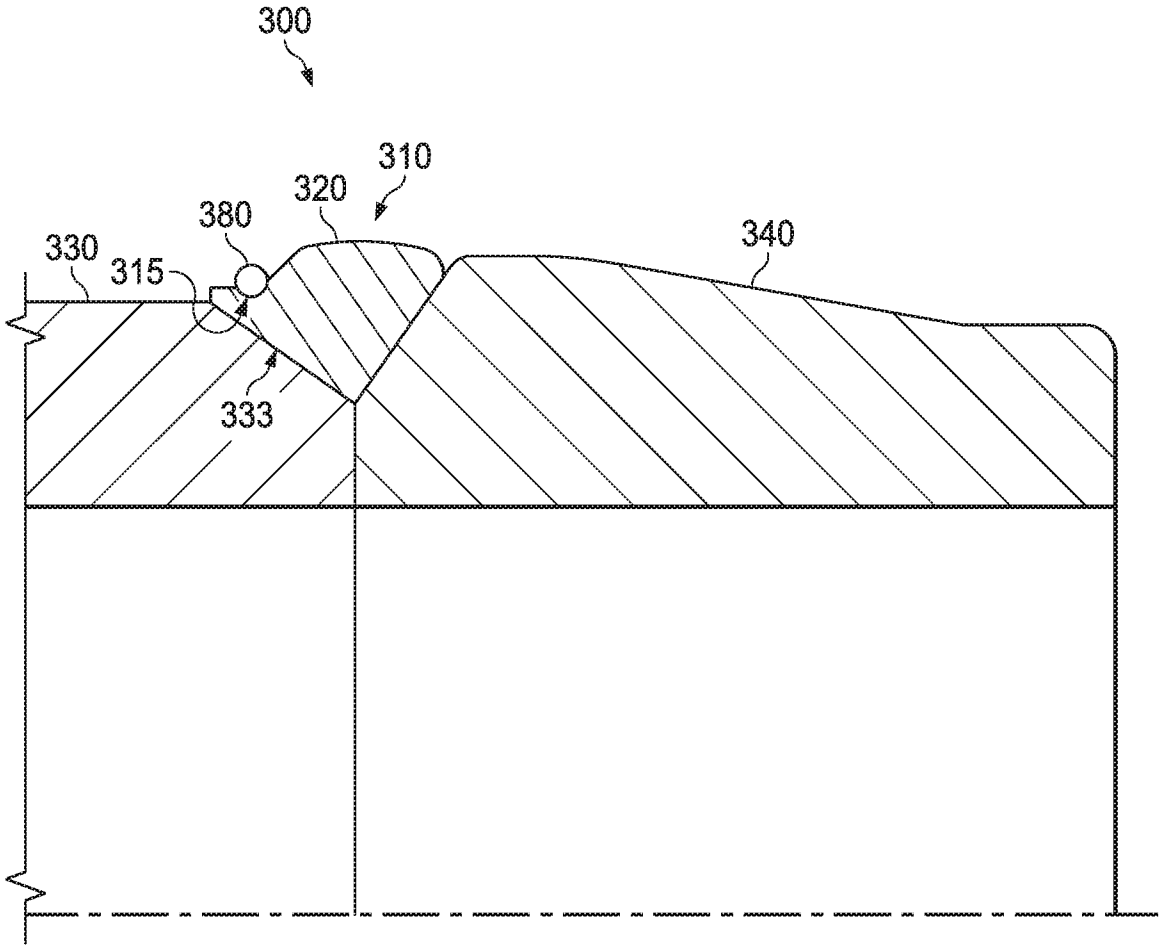
FIG. 3 is a sectional view of an expanding cone assembly fastened to a cone mandrel using a compressive ring.

Referring now to FIG. 3, there is shown a sectional view of an expansion assembly 300 comprising an expanding cone assembly 310 coupled around cone mandrel 330 at a distal end thereof via a compressive band 380. In this embodiment, each of a plurality of sections 320 includes an inverted collar 315 for receiving the compressive band 380 therein. The compressive band 380 maintains the plurality of sections 320 in an annular ring formation, while keeping the expanding cone assembly 310 in mating engagement with angled face 333 of cone mandrel 330. Likewise, the compressive band 380 is relatively flexible to allow the plurality of sections 320 to expand and contract radially into larger and smaller outer diameters as pressure is applied to the expanding cone assembly 310. In addition to using the compressive band 380, a c-ring, O-ring, or other flexible band, ring, or clamp may be used around the plurality of sections 320.

Figure 4A:
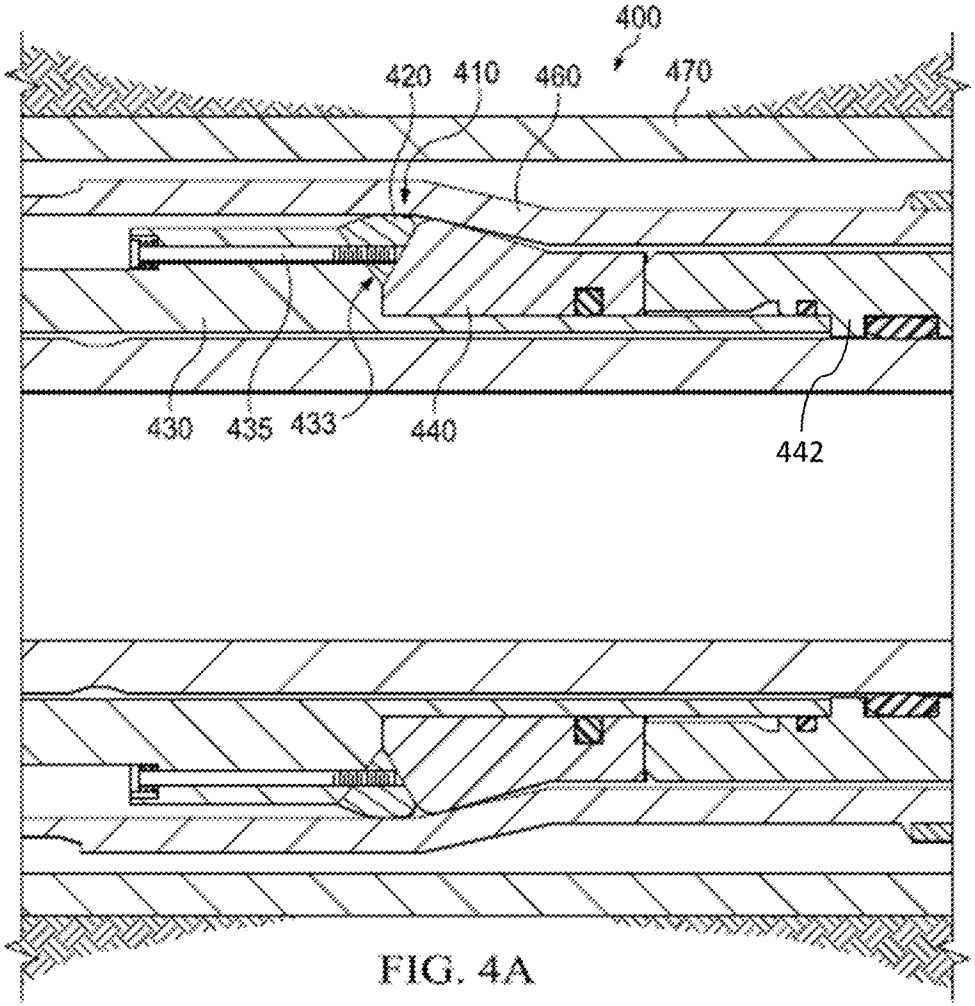
FIG. 4A is a sectional view showing an expanding cone assembly fastened to a cone mandrel using horizontal screws.
Figure 4B:
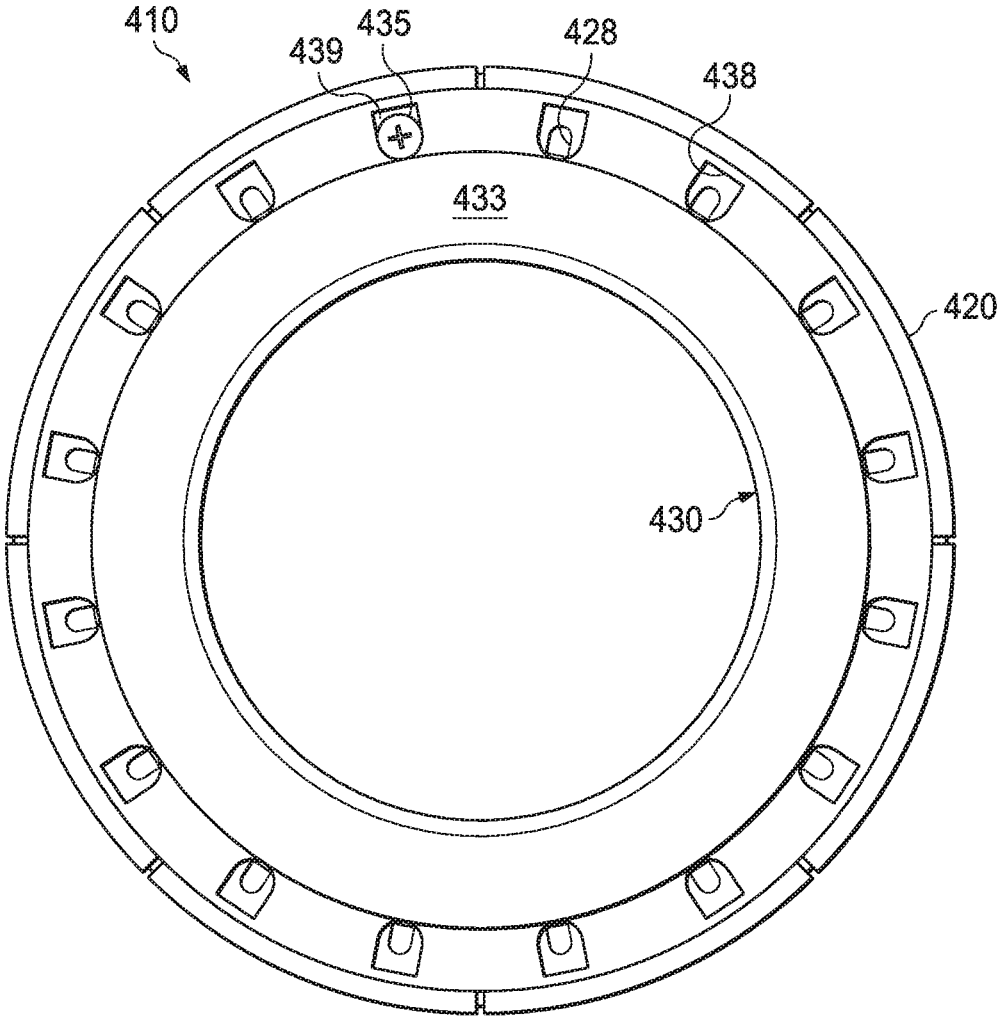
FIG. 4B is a side view of the face of the cone mandrel of FIG. 4A at a distal end that fastens to the expanding cone assembly.
Figure 4C:
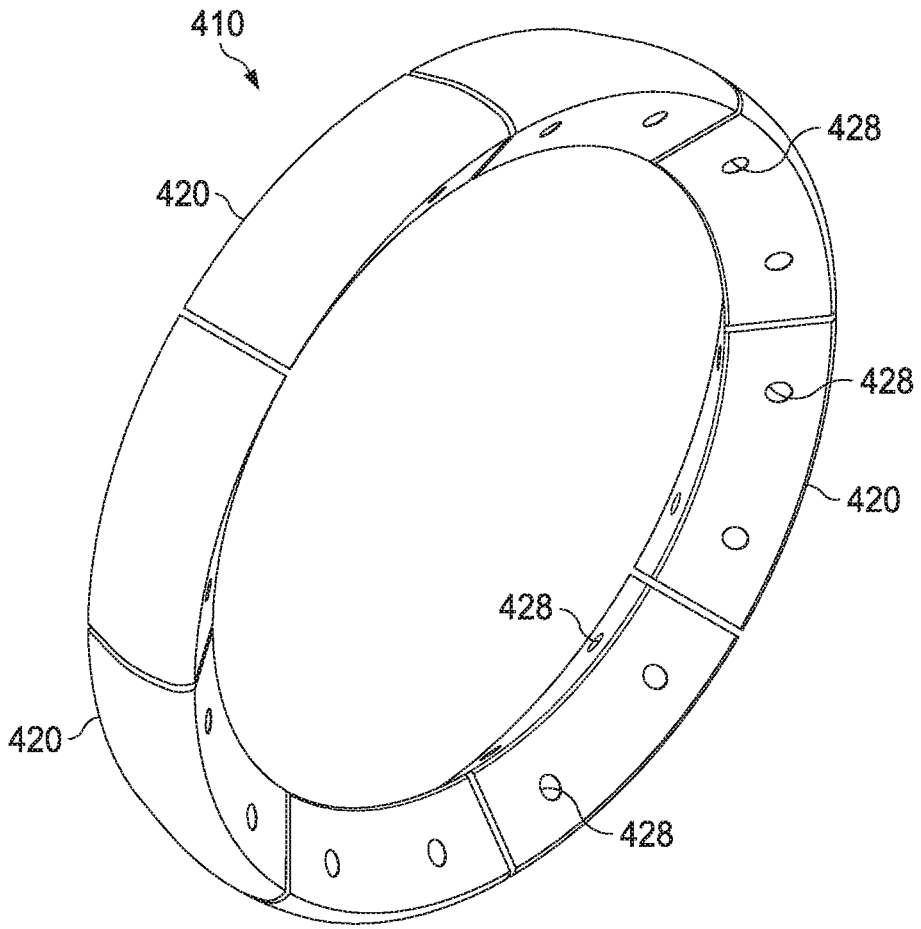
FIG. 4C is a perspective view of the expanding cone assembly shown in FIG. 4A.

Referring now to FIGS. 4A-4C there is shown an expansion assembly 400 having an expanding cone assembly 410 coupled between cone mandrel 430 and lead cone 440. In some embodiments, a cone shoe 442 may be positioned adjacent the lead cone 440, but there may be embodiments without a cone shoe. In this embodiment, the expanding cone assembly 410 is fastened to the cone mandrel 430 via fasteners 435 (e.g., horizontal fastener as shown). FIG. 4B illustrates an angled face 433 of cone mandrel 430. As can be ascertained from this view, the angled face 433 has apertures 438 therein for the fasteners 435, such as e.g., threaded screws, to protrude therefrom and thread into a plurality of receiving apertures 428 in each of the plurality of sections 420. This is similarly shown in the expanding cone assembly 410 of FIG. 4C. In the embodiment shown, above the fasteners 435 are springs 439. As the expansion assembly 400 is inserted downhole, the springs 439 are compressed as the expanding cone assembly 410 is in its first outer diameter. During extraction uphole, the cone mandrel 430 will pull the expansion assembly 400 uphole, drawing the expanding cone assembly 410 away from the lead cone 440, further compressing the springs 439 such that the plurality of sections 420 of expanding cone assembly 410 each slide downward along the face 433 of the cone mandrel 430 and thereby radially inward into the a second smaller outer diameter. There may be, in some embodiments, additional slots in the apertures 438 for fasteners to enable the plurality of sections 420 to slide further down on the face 433 of cone mandrel 430, but preventing the plurality of sections 420 from moving upward and radially outward. In some embodiments, wave washers may be used instead of springs 439, and other similar functioning fastening components to achieve compression of the fasteners 435.

Figure 4D:
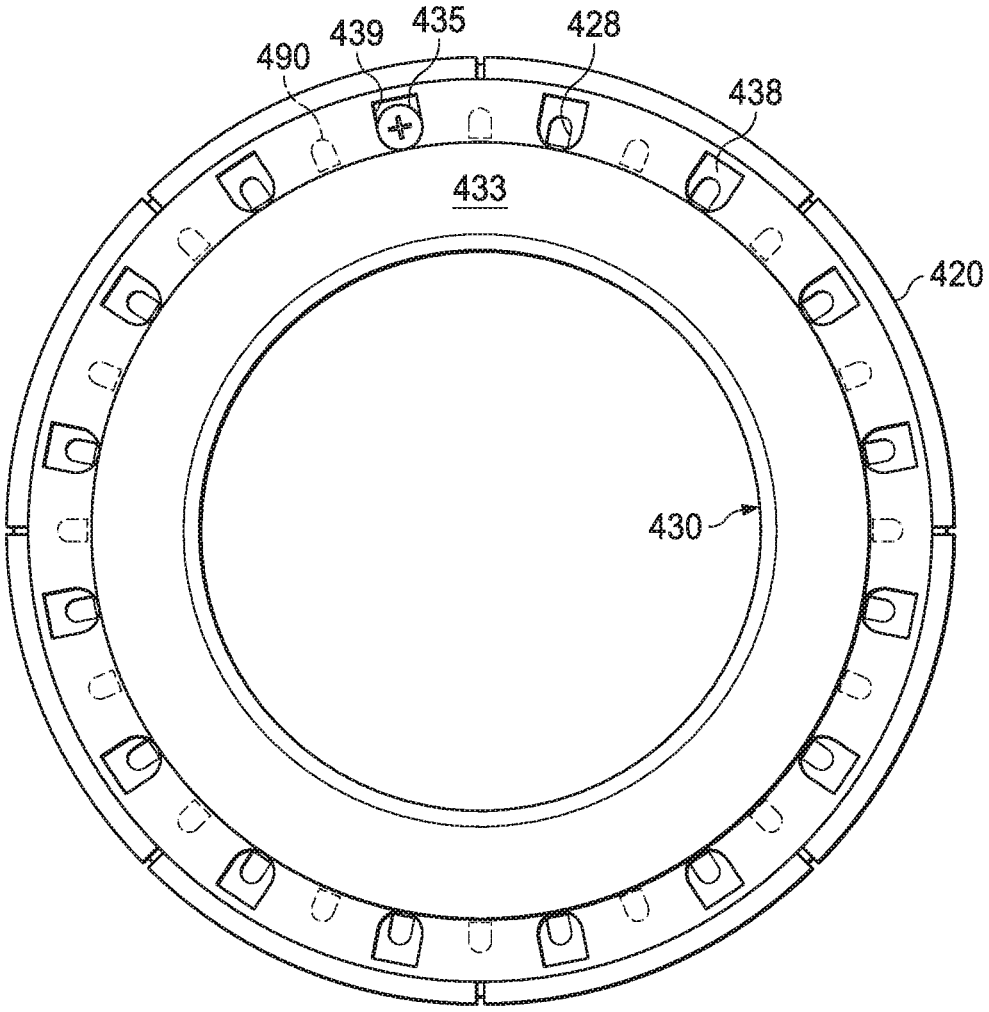
FIG. 4D is a side view of an expanding cone assembly showing alternate fastener locations.
Figure 4E:
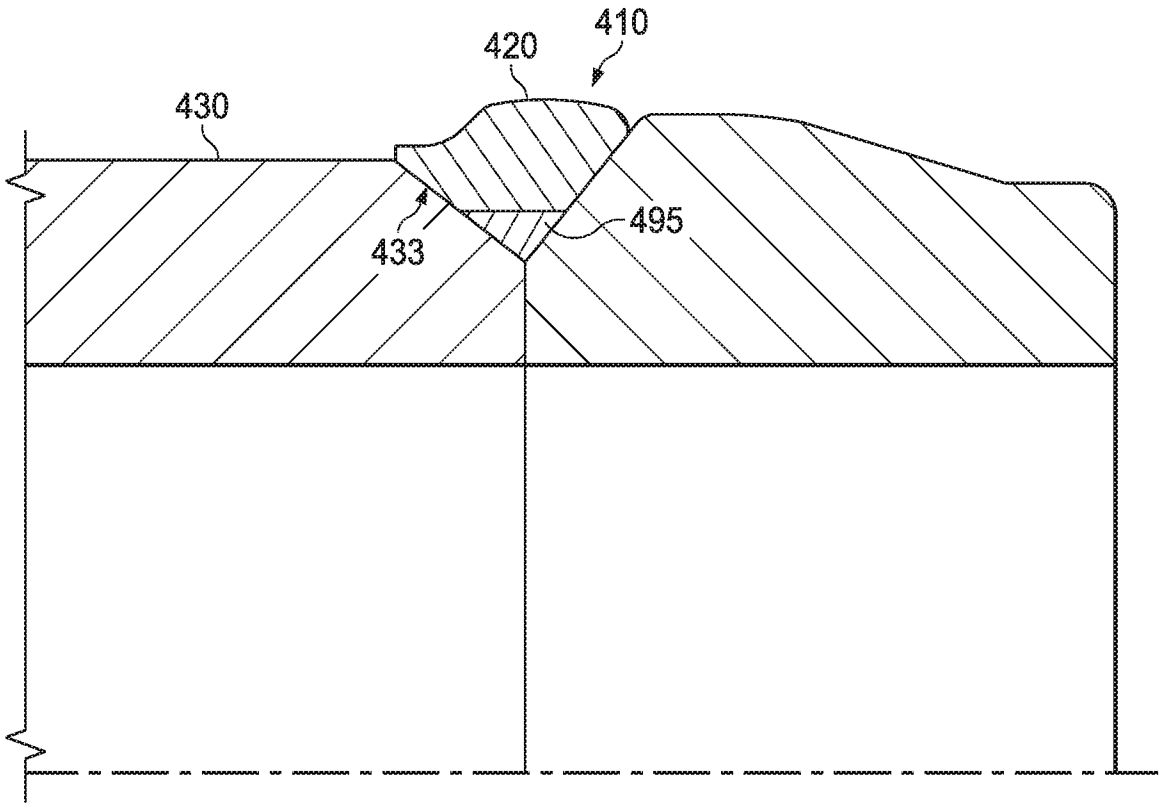
FIG. 4E is a sectional view of the expanding cone assembly according to FIG. 4D coupled between a cone mandrel and lead cone.

FIGS. 4D and 4E illustrate alternate placement of apertures 438 in the cone mandrel 430 to accommodate for varying equipment and casing sizes. As shown in in FIG. 4D, an additional set of apertures 490 may be provided on face 433 of cone mandrel 430. The additional set of apertures 490 enables expanding cone assembly 410 to be used for varying casing and equipment sizes, rather than having to manufacture a different size cones as have been conventionally required. As shown in FIG. 4E, there may be a gap beneath the expanding cone assembly 410 when the plurality of sections 420 are fastened into the additional set of apertures 490. A collar 495, or similar band or spacer may be placed beneath to support the expanding cone assembly 410 during downhole insertion, but will collapse and compress as the expanding cone assembly 410 is compressed down into a smaller diameter. In some embodiments, the plurality of sections 420 may be configured having flat surface on the bottom side thereof to avoid interference with the collar 495.

Figure 5:
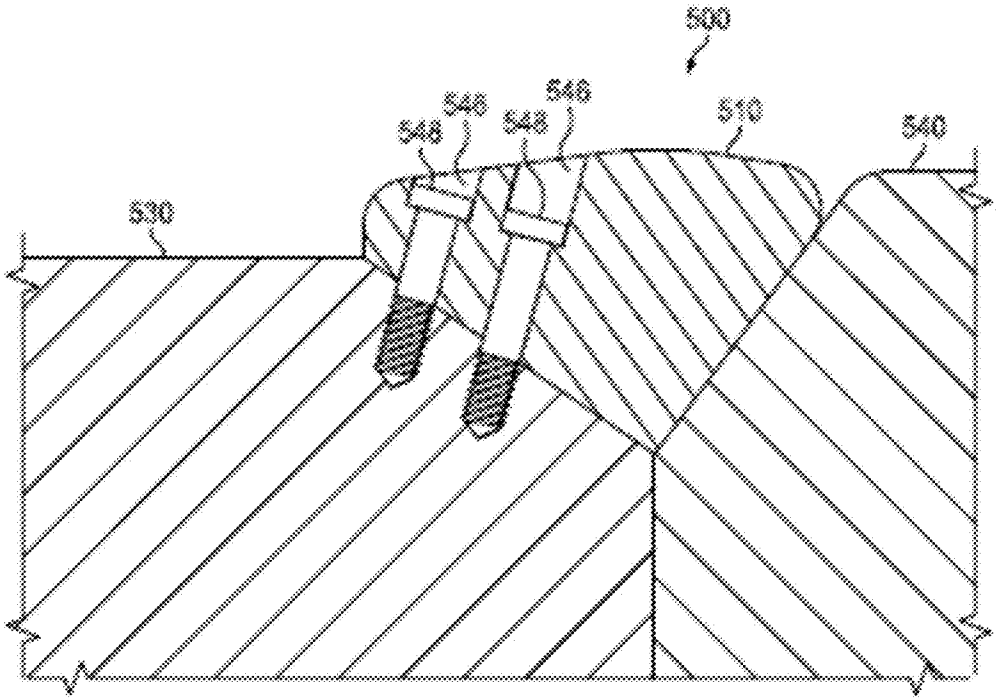
FIG. 5 is a side sectional view showing an expanding cone assembly fastened to a cone mandrel using vertical screws.

FIG. 5 illustrates another embodiment of an expansion assembly 500 wherein an expanding cone assembly 510 includes apertures 546 therein for threaded fasteners 548 to extend downward (e.g., radially inward in one embodiment) and thread into receiving apertures on cone mandrel 530. The fasteners 548 may likewise comprise a spring or washer which in a compressed state holds each of the plurality of sections 520 in a first outer diameter position during insertion downhole, and then decompress as the expansion assembly 500 is extracted uphole, allowing the plurality of sections 520 to radially collapse inward into a second outer diameter position.

Figure 6:
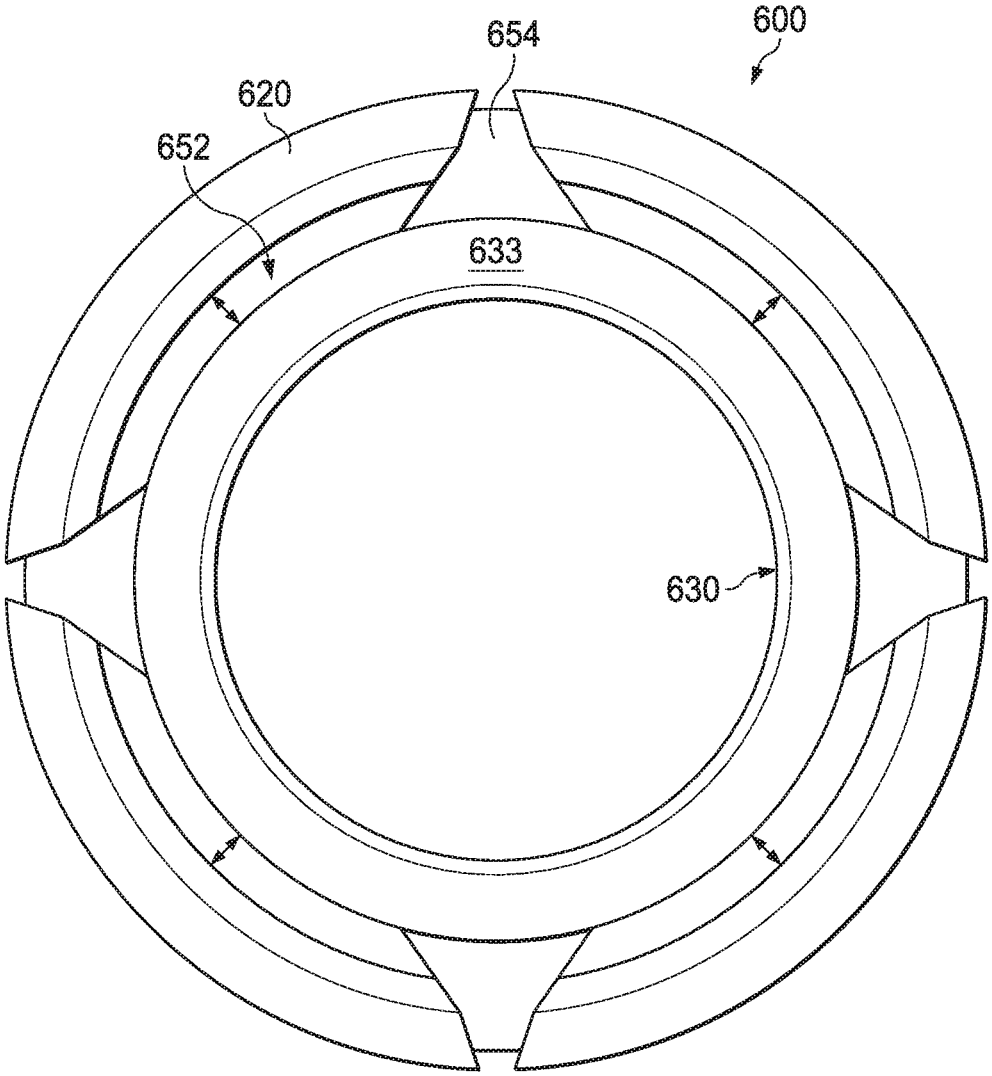
FIG. 6 is a side view of an expanding cone assembly that may fasten with a cone mandrel via a shape fit.

Referring now to FIG. 6, there is shown another embodiment of expansion assembly 600. In expansion assembly 600, cone mandrel 630 has a face 633 having female slots 652 between protrusions 654 for individually receiving one of the plurality of sections 620 of expanding cone assembly 610 therein. Each of the plurality of sections 620 mates into the female slots 652 and slides along protrusions 654 as each section remains matingly engaged with the face 633 of cone mandrel 630 both during downhole insertion and uphole extraction. In this embodiment, the plurality of sections 620 are positioned radially outward during downhole insertion and contracting radially inward during uphole extraction.

Figure 7:
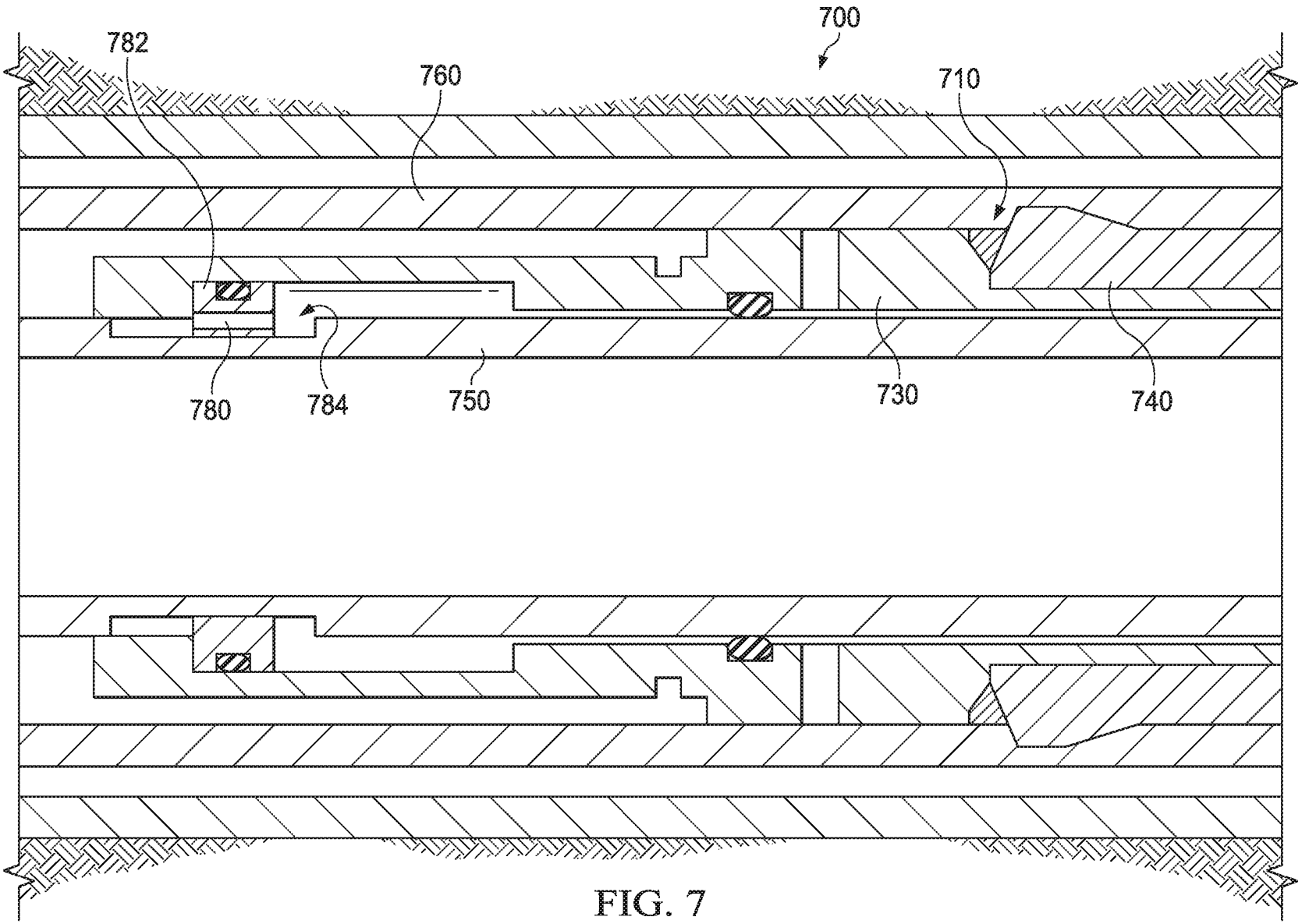
FIG. 7 is a side sectional view of another embodiment of an expansion assembly according to aspects of the present disclosure.

FIG. 7 is another embodiment of expansion assembly 700 illustrating a method of extraction for expansion assemblies without a cone shoe. The expansion assembly 700 includes an expanding cone assembly 710 coupled between a cone mandrel 730 and lead cone 740 and fastened about the cone mandrel 730 via a compressive band. A garter spring 780 is positioned about a sectioned collar 782 at a proximal end of the cone mandrel 730, resting atop setting tool 750. After liner hanger 760 is fully expanded, an uphole force is applied to the expansion assembly 700, causing the garter spring 780 to collapse off of cone mandrel 730 and into a running groove 784 of setting tool 750 enabling the cone mandrel 730 and expanding cone assembly 710 to axially shift away from lead cone 740. The sectioned collar 782 acts as a bearing face that picks up the cone mandrel 730 during uphole extraction, allowing the expanding cone assembly 710 to radially collapse into a smaller outer diameter. By eliminating the need for a cone shoe, lead cone 740 may be thicker and extend from the setting tool 750 upward without a portion of the cone mandrel 730 extending underneath. By lead cone 740 having a thicker vertical profile, lead cone 740 may withstand higher pressures, providing more strength to the expansion assembly.

In this embodiment, the expanding cone assembly 710 is shown fastened to the cone mandrel 730 by a compression ring, but the expanding cone assembly 710 may be fastened with the cone mandrel 730 via fasteners or a male-female mating engagement as previously discussed herein.

Those skilled in the art to which this application relates will appreciate that other and further additions, deletions, substitutions and modifications may be made to the described embodiments. Each of the foregoing embodiments may comprise one or more of the following additional elements singly or in combination, and neither the example embodiments or the following listed elements limit the disclosure, but are provided as examples of the various embodiments covered by the disclosure.

Embodiments disclosed herein include:

An expansion assembly for setting a liner hanger into mating engagement with an interior surface of a wellbore casing, the expansion assembly comprising: a cone mandrel; and an expanding cone assembly positioned adjacent the cone mandrel. The expanding cone assembly includes a plurality of sections, the plurality of sections positioned adjacent each other, each separable by a space S, and together forming an annular ring, wherein the plurality of sections are configured to expand radially outward to a first outer diameter when subjected to a linear downhole force when moving downhole and to contract radially inward to a second smaller outer diameter when moving uphole.

Another embodiment comprises an expansion assembly for setting a liner hanger into mating engagement with an interior surface of a wellbore casing, the expansion assembly comprising: a cone mandrel having an angled face; a lead cone having an angular face; and an expanding cone assembly positioned between the angled face of the cone mandrel and the angular face of the lead cone. The expanding cone assembly includes a plurality of sections, the plurality of sections positioned adjacent each other, each separable by a space s, and together forming an annular ring, wherein the plurality of sections are configured to expand radially outward to a first outer diameter when subjected to a linear downhole force when moving downhole and to contract radially inward to a second smaller outer diameter when moving uphole.

Another embodiment comprises a method for setting a liner hanger into mating engagement with an interior surface of a wellbore casing. This method comprises operably associating a setting tool having an expansion assembly with a liner string including the liner hanger, the expansion assembly comprising: a cone mandrel; a lead cone; and an expanding cone assembly positioned between the cone mandrel and the lead cone, the expanding cone assembly including: a plurality of sections, the plurality of sections positioned adjacent each other, each separable by a space s, and together forming an annular ring, wherein the plurality of sections are configured to expand radially outward to a first outer diameter when subjected to a linear downhole force when moving downhole and to contract radially inward to a second smaller outer diameter when moving uphole. The method further comprises lowering the liner string and setting tool into the wellbore casing; applying a force in the downhole direction to the expansion assembly such that the expanding cone assembly radially expands at least a portion of the liner hanger outward into engagement with the interior surface of wellbore casing; and applying a linear force in the uphole direction to the expansion assembly such that the lead cone shifts away from the expanding cone assembly and the cone mandrel thereby allowing the expanding cone assembly to shift radially inward into the second smaller outer diameter as the expansion assembly is extracted upward through the wellbore casing.

Each of the foregoing embodiments may comprise one or more of the following additional elements singly or in combination, and neither the example embodiments or the following listed elements limit the disclosure, but are provided as examples of the various embodiments covered by the disclosure:

Element 1: wherein each of the plurality of sections is coupled against a face of the cone mandrel by a threaded fastener.

Element 2: wherein the threaded fastener extends horizontally from the cone mandrel into each of the plurality of sections.

Element 3: wherein the threaded fastener extends radially inward from each of the plurality of sections into the cone mandrel.

Element 4: wherein the plurality of sections are coupled with the cone mandrel via a compressed ring.

Element 5: wherein the plurality of sections are positioned between protrusions extending from a face of the cone mandrel.

Element 6: wherein each of the plurality of sections is configured to pivot at an angle relative to the cone mandrel as the plurality of sections contract into the second smaller outer diameter.

Element 7: wherein a distal end of the cone mandrel extends beneath the expanding cone assembly, lead cone, and the cone shoe.

Element 8: wherein each of the plurality of sections is coupled with the cone mandrel by a threaded fastener.

Element 9: wherein a distal end of the cone mandrel includes protrusions and each of the plurality of sections is positioned between and above the protrusions.

Element 10: wherein a garter spring is positioned about a sectioned collar at a proximal end of the cone mandrel.

Element 11: wherein as the linear uphole force is applied to the expansion assembly, the garter spring collapses axially off of the cone mandrel and into a running groove of setting tool, moving the cone mandrel and expanding cone assembly axially away from the lead cone.

Element 12: wherein the expanding cone assembly is coupled about the cone mandrel via a compressed ring.

Element 13: wherein the expanding cone assembly is coupled about the cone mandrel via threaded fasteners.

The foregoing listed embodiments and elements do not limit the disclosure to just those listed above.

Those skilled in the art to which this application relates will appreciate that other and further additions, deletions, substitutions and modifications may be made to the described embodiments.

What is claimed is:

1. An expansion assembly for setting a liner hanger into mating engagement with an interior surface of a wellbore casing, comprising:

a cone mandrel having an angled face; and an expanding cone assembly positioned adjacent the cone mandrel, the expanding cone assembly including;

a plurality of sections, the plurality of sections positioned adjacent each other, each separable by a space (S) and each supported by the angled face of the cone mandrel, and together forming an annular ring, wherein each of the plurality of sections are configured to expand radially outward to a first outer diameter when subjected to a linear downhole force when moving downhole and to contract radially inward to a second smaller outer diameter when moving uphole.

2. The expansion assembly as recited in claim 1, wherein each of the plurality of sections is coupled against a face of the cone mandrel by a threaded fastener.

3. The expansion assembly as recited in claim 2, wherein the threaded fastener extends horizontally from the cone mandrel into each of the plurality of sections.

4. The expansion assembly as recited in claim 2, wherein the threaded fastener extends radially inward from each of the plurality of sections into the cone mandrel.

5. The expansion assembly as recited in claim 1, wherein the plurality of sections are coupled with the cone mandrel via a compressed ring.

6. The expansion assembly as recited in claim 1, wherein the plurality of sections are positioned between protrusions extending from a face of the cone mandrel.

7. The expansion assembly as recited in claim 1, wherein each of the plurality of sections is configured to collapse radially inward at an angle relative to the cone mandrel as the plurality of sections contract into the second smaller outer diameter.

8. An expansion assembly for setting a liner hanger into mating engagement with an interior surface of a wellbore casing, the expansion assembly comprising:

a cone mandrel having an angled face;

a lead cone having an angular face; and an expanding cone assembly supported by both the angled face of the cone mandrel and the angular face of the lead cone, the expanding cone assembly including:

a plurality of sections, the plurality of sections positioned adjacent each other, each separable by a space (S), and together forming an annular ring, wherein each of the plurality of sections are configured to expand radially outward to a first outer diameter when subjected to a linear downhole force when moving downhole and to contract radially inward to a second smaller outer diameter when moving uphole.

9. The expansion assembly as recited in claim 8, further including a cone shoe, wherein a distal end of the cone mandrel extends beneath the expanding cone assembly, lead cone, and the cone shoe.

10. The expansion assembly as recited in claim 8, wherein each of the plurality of sections is coupled with the cone mandrel by a threaded fastener.

11. The expansion assembly as recited in claim 10, wherein the threaded fastener extends horizontally from the cone mandrel into each of the plurality of sections.

12. The expansion assembly as recited in claim 10, wherein the threaded fastener extends radially inwardly from each of the plurality of sections into the cone mandrel.

13. The expansion assembly as recited in claim 8, wherein the plurality of sections are coupled with the cone mandrel via a compressed ring.

14. The expansion assembly as recited in claim 8, wherein a distal end of the cone mandrel includes protrusions and each of the plurality of sections is positioned between and above the protrusions.

15. The expansion assembly as recited in claim 8, wherein each of the plurality of sections is configured to collapse radially inward at an angle relative to the cone mandrel as the plurality of sections contract into the second smaller outer diameter.

16. A method for setting a liner hanger into mating engagement with an interior surface of a wellbore casing, the method comprising:

operably associating a setting tool having an expansion assembly with a liner string including the liner hanger, the expansion assembly comprising:

a cone mandrel;

a lead cone; and an expanding cone assembly supported by both the cone mandrel and the lead cone, the expanding cone assembly including:

a plurality of sections, the plurality of sections positioned adjacent each other, each separable by a space (S), and together forming an annular ring, wherein each of the plurality of sections are configured to expand radially outward to a first outer diameter when subjected to a linear downhole force when moving downhole and to contract radially inward to a second smaller outer diameter when moving uphole;

lowering the liner string and setting tool into the wellbore casing;

applying a force in the downhole direction to the expansion assembly such that the expanding cone assembly radially expands at least a portion of the liner hanger outward into engagement with the interior surface of wellbore casing; and applying a linear force in the uphole direction to the expansion assembly such that the lead cone shifts away from the expanding cone assembly and the cone mandrel thereby allowing the expanding cone assembly to shift radially inward into the second smaller outer diameter as the expansion assembly is extracted upward through the wellbore casing.

17. The method for setting a liner hanger as recited in claim 16, wherein a garter spring is positioned about a sectioned collar at a proximal end of the cone mandrel.

18. The method for setting a liner hanger as recited in claim 17, wherein as the linear uphole force is applied to the expansion assembly, the garter spring collapses axially off of the cone mandrel and into a running groove of the setting tool, moving the cone mandrel and expanding cone assembly axially away from the lead cone.

19. The method for setting a liner hanger as recited in claim 16, wherein the expanding cone assembly is coupled about the cone mandrel via a compressed ring.

20. The method for setting a liner hanger as recited in claim 16, wherein the expanding cone assembly is coupled about the cone mandrel via threaded fasteners.

* * * * *